US005314013A

United States Patent [19]

Tanabe

[11] Patent Number: 5,314,013

[45] Date of Patent: May 24, 1994

[54] HEAT EXCHANGER

[75] Inventor: Kenichi Tanabe, Takasaki, Japan

[73] Assignee: Sanden Corporation, Isesaki, Japan

[21] Appl. No.: 851,455

[22] Filed: Mar. 16, 1992

[30] Foreign Application Priority Data

Mar. 15, 1991 [JP] Japan ..... 3-015392[U]
Mar. 15, 1991 [JP] Japan ..... 3-015395[U]

[51] Int. Cl.[5] ..... F28D 1/047
[52] U.S. Cl. ..... 165/176; 165/177
[58] Field of Search ..... 165/174, 176, 177

[56] References Cited

U.S. PATENT DOCUMENTS 3,746,525 7/1973 Kasuga et al. ..... 165/176 X
4,770,240 9/1988 Dawson et al. ..... 165/176
4,825,941 5/1989 Hoshiro et al. ..... 165/110
4,860,823 8/1989 Noguchi ..... 165/153

FOREIGN PATENT DOCUMENTS 3302150 7/1984 Fed. Rep. of Germany ..... 165/176
2166862A 5/1986 United Kingdom ..... 165/176

*Primary Examiner*—Allen J. Flanigan
*Attorney, Agent, or Firm*—Baker & Botts

[57] ABSTRACT

An evaporator for an automotive air conditioning refrigeration circuit includes first and second header pipes, a plurality of communicating members which comprise a substantially U-shaped communication path therein, and a corrugated fin unit fixedly disposed between the U-shaped flat pipes. The first and second header pipes are disposed parallel to each other. Each of the U-shaped flat pipes includes a pair of straight portions and a U-shaped curved portion which connects the lower ends of the straight portions. An upper end of one of the straight portions is fixedly and hermetically connected to the first header pipe, and an upper end of the other straight portion is fixedly and hermetically connected to the second header pipe. The pair of the straight portions and the U-shaped curved portion of the U-shaped flat pipe extend along a plane which is parallel to the flow direction of air passing an exterior surface of the evaporator.

2 Claims, 6 Drawing Sheets

HEAT EXCHANGER

BACKGROUND OF THE INVENTION

1. Technical Field

This invention relates to a heat exchanger for a refrigeration circuit and more particularly, to an evaporator for an automotive air conditioning refrigeration circuit.

2. Description of the Prior Art

Evaporators for use in automotive air conditioning refrigeration circuits are known in the art, for example, U.S. Pat. No. 4,892,143 to Ishii. With reference to FIG. 1, a serpentine-type evaporator or heat exchanger discussed in the Ishii '143 patent is shown. Evaporator 100 includes a continuous serpentine tube 101 through which refrigeration fluid flows. Serpentine tube 101 includes a plurality of spaced, planar portions 101*a* and a corresponding plurality of curved connecting portions 101*b*. The planar portions 101*a* are parallel to one another and vertically disposed so as to be parallel to the flow direction "A" of air which passes an exterior surface of evaporator 100. One end of serpentine tube 101 is brazed to a fluid inlet pipe 102. The fluid inlet pipe 102 is linked to the output of a compression or an expansion means (for example, a compressor, not shown) of a refrigeration circuit. The other end of serpentine tube 101 is brazed to a fluid outlet pipe 103. The fluid outlet pipe 103 is linked to the inlet of the compressor.

Refrigeration fluid is provided to serpentine tube 101 from the compressor via inlet pipe 102, flows through each successive planar portion 101*a* and connecting portion 101*b* towards outlet pipe 103, and is then returned to the compressor. Of course, the refrigeration circuit may include other elements disposed between the compressor and evaporator 100.

The curved connecting portions of the evaporator discussed in Ishii '143 are formed by bending a straight tube. However, when the number of planar portions of the evaporator are increased in order to increase its ability to exchange heat, the radius of curvature of the curved connecting portions must be decreased. When a straight tube is bent with a small radius, the outer region of the resulting curved connecting portion becomes excessively thin. As a result, the mechanical strength and corrosion resistance of the outer regions is remarkably decreased. Therefore, the life of the evaporator decreases considerably. Accordingly, the ability of the Ishii device to exchange heat can only be increased a small amount due to the limits on the number of planar portions which can be formed.

Furthermore, since the refrigeration fluid flows through each of the planar portions and the curved connecting portions in succession from the inlet pipe to the outlet pipe, the efficiency of the heat exchange between the refrigeration fluid flowing through the serpentine tube and the air passing the exterior surface of the evaporator gradually decreases from the inlet pipe to the outlet pipe. Therefore, the air temperature leaving the exterior surface of the evaporator is not uniform across the evaporator. As a result, an improved elaborate automobile air conditioning system cannot be obtained.

Moreover, the water drops condensed on the exterior surface of the evaporator tend to be concentrated at an inner surface of each of the lower curved connecting portions. These gathered water drops may be scattered into the passenger compartment of an automobile by the air blown from an evaporator fan.

SUMMARY OF THE INVENTION

Accordingly it is an object of the present invention to provide an evaporator whose ability to exchange heat can be greatly increased without reducing the life of the evaporator.

It is another object of the present invention to provide an evaporator which at any portion thereof has a generally uniform air temperature leaving its exterior surface.

It is still another object of the present invention to provide an evaporator which effectively drains the water drops condensed at the exterior surface thereof.

An evaporator according to the present invention includes a pair of header pipes disposed substantially parallel to each other and a plurality of communicating members for providing communication between the interior space of one header pipe with the interior space of the other header pipe. Each of the communicating members includes a first portion which communicates with the interior chamber of one header pipe, a second portion which communicates with the interior space of the other header pipe, and a third portion which communicates between the first portion and the second portion. The first, second, and third portions of the communicating member extend along a plane that is parallel to the flow direction of a fluid, such as air, which passes an exterior surface of the evaporator.

DETAILED DESCRIPTION OF THE PREFERRED EMBODIMENTS

Figure 1:
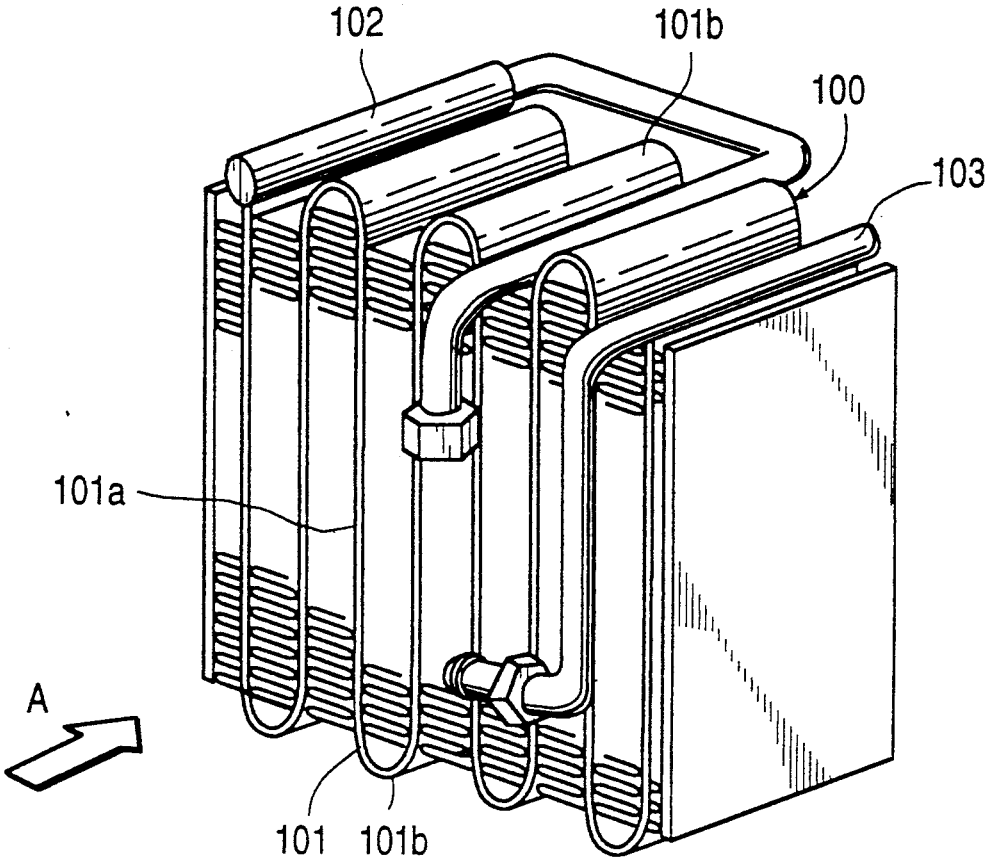
FIG. 1 PRIOR ART
FIG. 1 illustrates a perspective view of one prior art evaporator.
Figure 2:
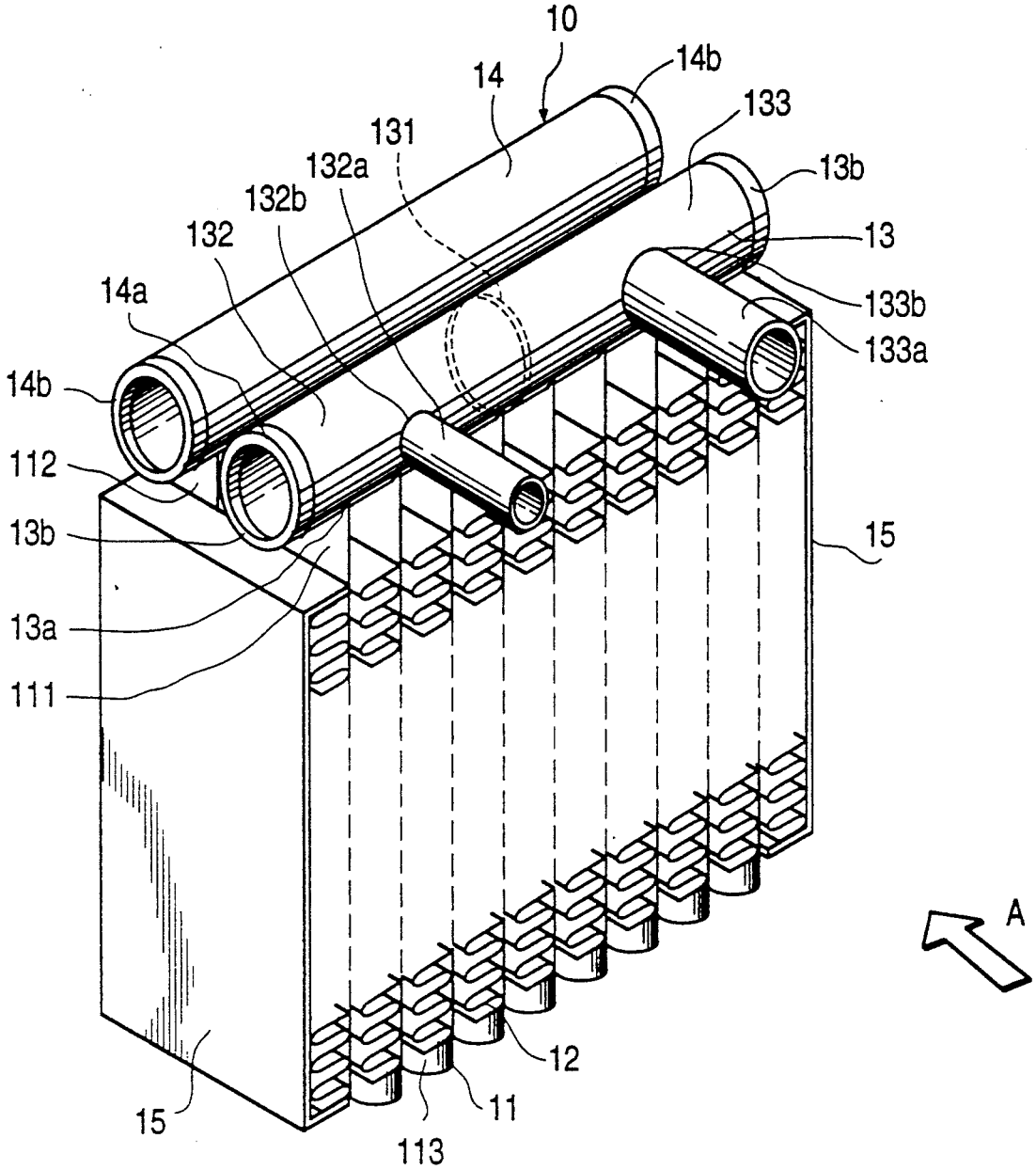
FIG. 2 illustrates a perspective view of an evaporator in accordance with a first embodiment of the present invention.

FIG. 2 illustrates a perspective view of a heat exchanger, such as an evaporator for an automotive air conditioning refrigeration circuit, in accordance with a first embodiment of the present invention. Evaporator 10 includes a plurality of U-shaped flat tubes 11 and a plurality of corrugated fins 12 which are fixedly disposed between the adjacent tubes 11.

Figure 3:
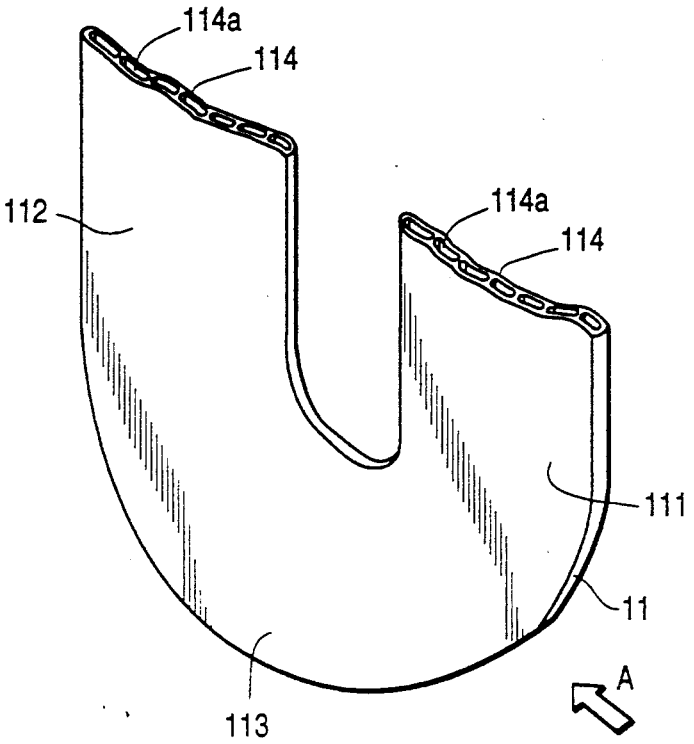
FIG. 3 illustrates an enlarged partial perspective view of an U-shaped flat tube shown in FIG. 2.
Figure 4:
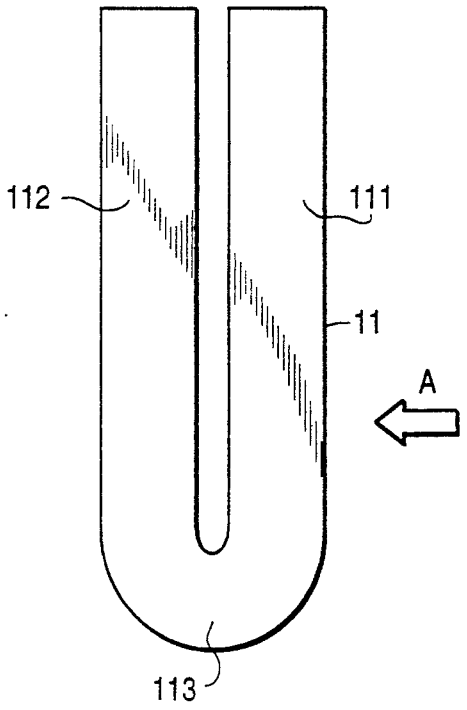
FIG. 4 illustrates a side view of the U-shaped flat tube shown in FIG. 2.

Referring to FIGS. 3 and 4 additionally, U-shaped flat tube 11 includes a pair of straight sections 111 and 112. U-shaped curved section 113 connects the lower ends of straight sections 111 and 112. Straight sections 111, 112 and U-shaped curved section 113 are coplanar and extend along a vertical plane which is parallel to the flow direction (shown by "A" in FIGS. 2–4) of air which passes along the exterior surfaces of evaporator 10. Straight section 112 is located rearwardly (to the left in FIG. 2) of straight section 111 with respect to the direction of air passing evaporator 10.

As shown in FIG. 3, the interior space of tube 11 is divided by a plurality of parallel partition walls 114 into a corresponding plurality of essentially parallel passages 114*a* through which refrigeration fluid flows.

A lower end of U-shaped curved section 113 of each of tubes 11 projects downwardly from a lower end of corrugated fins 12. An upper end of straight section 111 of each of tubes 11 upwardly projects from an upper end of adjacent corrugated fin 12. The upper end of straight section 111 is fixedly and hermetically connected to a lower portion of first cylindrical header pipe 13 through slot 13*a* thereby enabling the interior space of cylindrical header pipe 13 to communicate with passages 114*a* defined within tube 11. An upper end of straight section 112 of each of tubes 11 upwardly projects from an upper end of adjacent corrugated fin 12. The upper end of straight portion 112 is fixedly and hermetically connected to a lower portion of second cylindrical header pipe 14 through slot 14*a* thereby enabling the interior space of cylindrical header pipe 14 to communicate with passages 114*a* defined within tube 11. First and second cylindrical header pipes 13 and 14 are disposed parallel to each other.

Circular plate 131 is fixedly disposed within a mid-region of first cylindrical header pipe 13 so as to divide the interior space of cylindrical header pipe 13 into a first chamber section 132 and a second chamber section 133. Inlet pipe 132*a* is fixedly and hermetically connected to a front portion of cylindrical header pipe 13 through opening 132*b* so as to link first chamber section 132 of cylindrical header pipe 13 to an output of a compressor which forms a part of the refrigeration circuit. Outlet pipe 133*a*, is also fixedly and hermetically connected to a front portion of cylindrical header pipe 13 through opening 133*b* so as to link second chamber section 133 of cylindrical header pipe 13 to the inlet of the compressor.

Of course, the refrigeration circuit may include other elements disposed between the compressor and evaporator 10, such as a condenser, an accumulator and an expansion valve. A pair of cap members 13*b* are fixedly and hermetically connected to the respective open ends of first cylindrical header pipe 13. A cap member 14*b* is fixedly and hermetically connected to each of the open ends of second cylindrical header pipe 14. A pair of side plates 15 are fixedly connected to the opposite outer corrugated fins 12, respectively.

Figure 8:
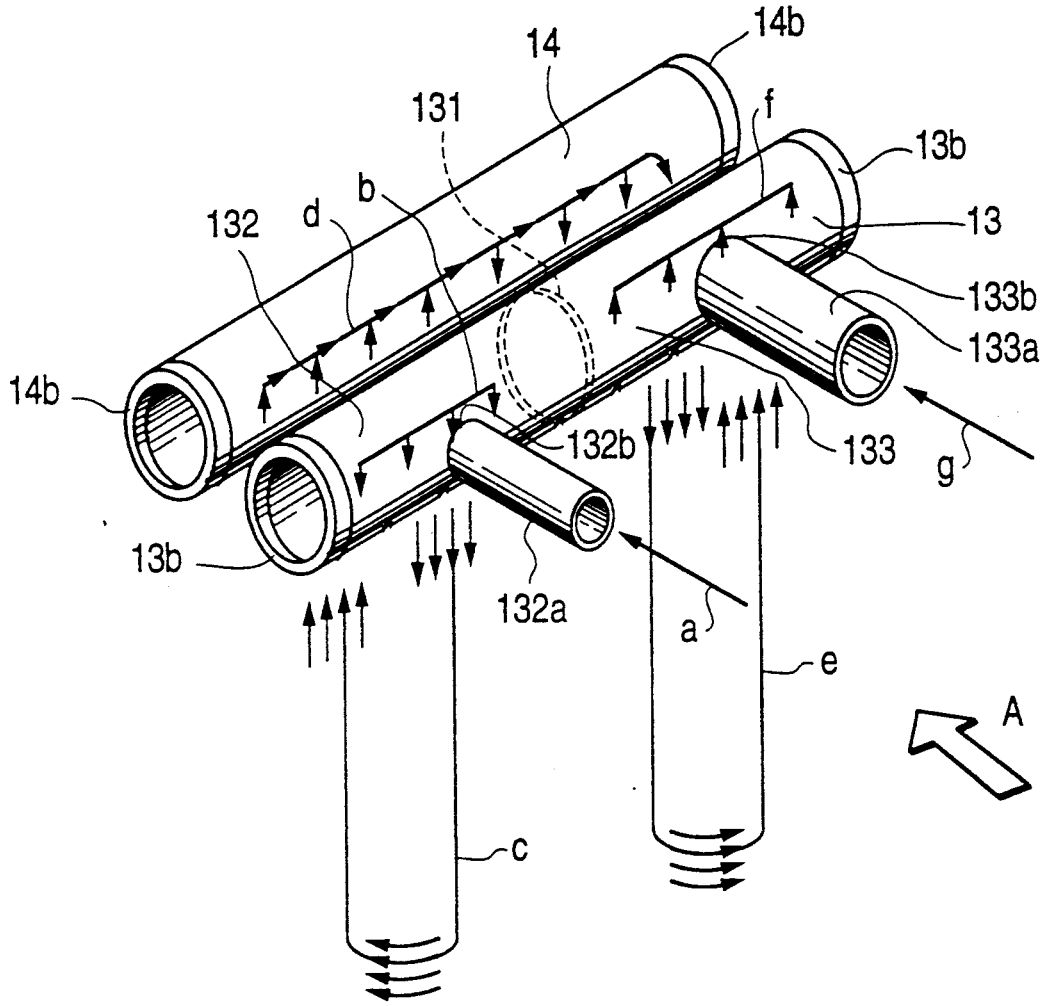
FIG. 8 illustrates a schematic perspective view of the evaporator in accordance with the first and second embodiments of the present invention.

Referring to FIG. 8, when the compressor of the refrigeration circuit operates, the refrigeration fluid successively flows preferably through flow paths "a'-'-"g" as described below. Of course other flow arrangements could be used. In flow path "a", the refrigeration fluid flows from the outlet of the compressor, through the condenser, the accumulator, and the expansion valve, through the inlet pipe 132*a*, and into first chamber section 132 of first cylindrical header pipe 13. In flow path "b", the refrigeration fluid in first chamber section 132 is distributed to straight sections 111 of the corresponding first tubes 11. In flow path "c", the refrigeration fluid flows downwardly through each of the straight sections 111 of the first tubes, around each of the corresponding U-shaped curved sections 113, and then upwardly through each of the corresponding straight sections 112. Heat is exchanged as the air passing along the exterior surface of evaporator 10 vaporizes the refrigeration fluid.

In flow path "d", the refrigeration fluid in each of straight sections 112 of the first tubes 11 flows into a first half of the interior space of second cylindrical header pipe 14. The refrigeration fluid mixes together as it flows to the second half of the interior space of cylindrical header pipe 14. The refrigeration fluid is then is distributed to the straight sections 112 of the remaining second set of tubes 11.

In flow path "e", the refrigeration fluid flows downwardly through each of the remaining straight sections 112, around each of the corresponding U-shaped curved sections 113, and then upwardly through each of the corresponding straight sections 111 which are linked to second chamber section 133 of first cylindrical header pipe 13. Heat is exchanged as the air passing along the exterior surface of evaporator 10 vaporizes the refrigeration fluid. In flow path "f", the refrigeration fluid in each of straight sections 111 flows into second chamber section 133 of first cylindrical header pipe 13 and mixes together. In flow path "g", the refrigeration fluid in second chamber section 133 of first cylindrical header pipe 13 flows to the inlet of the compressor through outlet pipe 133*a*.

According to the evaporator of the first embodiment of the present invention, the number of the U-shaped flat tubes can be easily increased to a large value because, in contrast to the prior art discussed above, there are no curved portions connecting the tubes together. Therefore, the heat exchange tubes 11 can be spaced closer together without the concomitant concerns associated with bending the pipes with a small radius of curvature. As a result, the ability of the evaporator to exchange heat can be greatly increased without a corresponding reduction in the life of the evaporator.

Furthermore, because the refrigeration fluid flows in parallel independently through each of the U-shaped flat tubes, the efficiency of the heat exchange performed by the evaporator is generally uniform at any portion thereof. As a result, an improved elaborate air conditioning system for an automobile can be obtained.

Moreover, since the evaporator of the first embodiment does not include the lower curved connecting portions discussed in the Ishii '143 patent, water drops condensed at the exterior surface of the present evaporator can be effectively drained.

Figure 5:
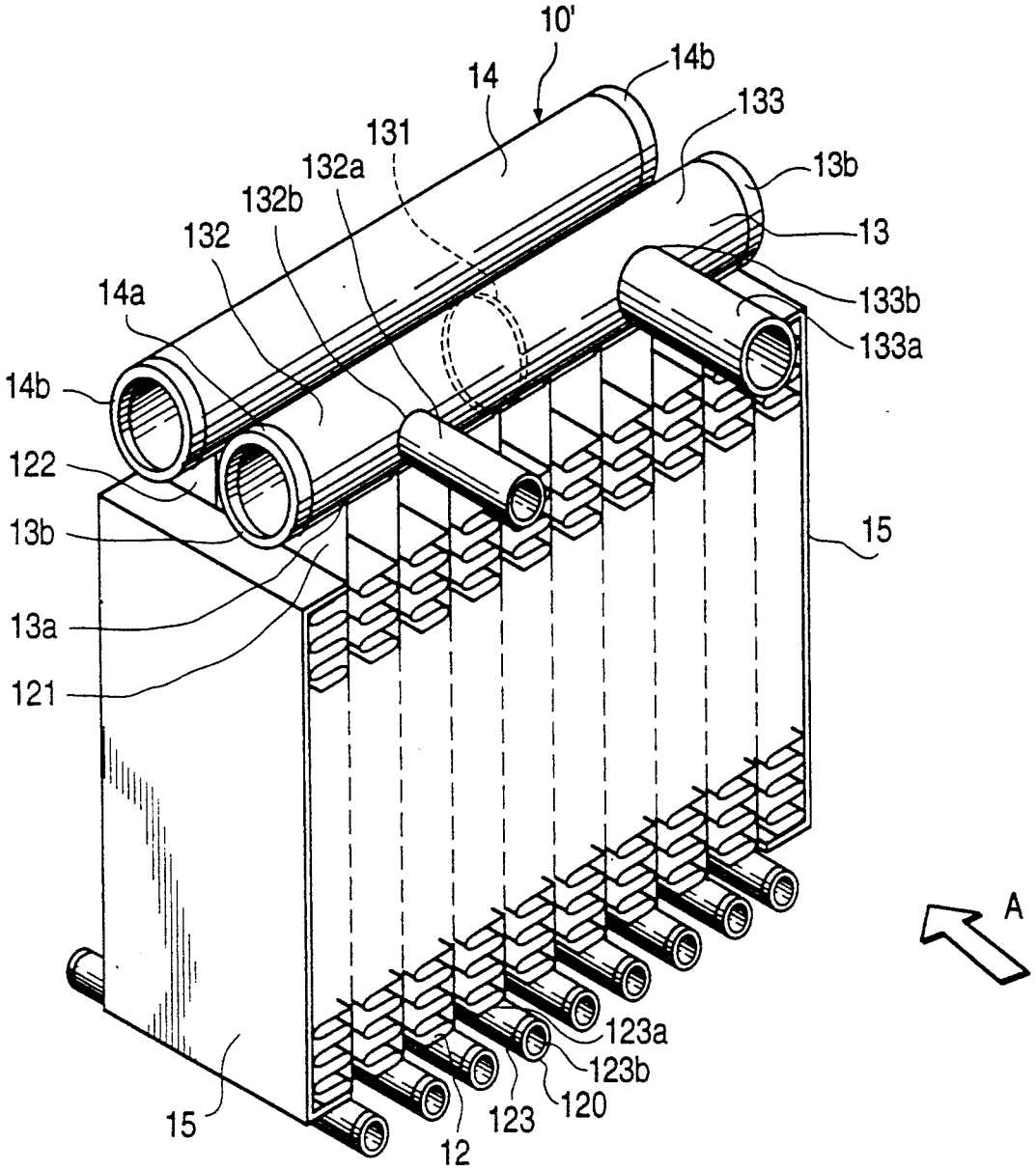
FIG. 5 illustrates a perspective view of an evaporator in accordance with a second embodiment of the present invention.

FIG. 5 illustrates a perspective view of an evaporator for an automotive air conditioning refrigeration circuit in accordance with a second embodiment of the present invention. The reference numerals of FIG. 5 which are common to FIG. 2 refer to the same elements described in connection with FIG. 2.

Referring to FIG. 5, evaporator 10' includes a plurality of communicating units 120 which function in a manner substantially similar to the U-shaped flat tubes 11 of the first embodiment. Communicating unit 120 includes a pair of flat tubes 121 and 122. Cylindrical tube 123 is fixedly and hermetically connected to the lower end of each of tubes 121, 122 through slot 123*a* formed at a top portion of cylindrical tube 123. Flat tubes 121, 122 and cylindrical tube 123 are coplanar and extend along a vertical plane which is parallel to the flow direction (shown by "A" in FIG. 5) of air which passes an exterior surface of evaporator 10'. Flat tube 122 is located rearwardly (to the left in FIG. 5) of flat tube 121 with respect to the direction of air passing the exterior surface of evaporator 10'.

Figure 7:
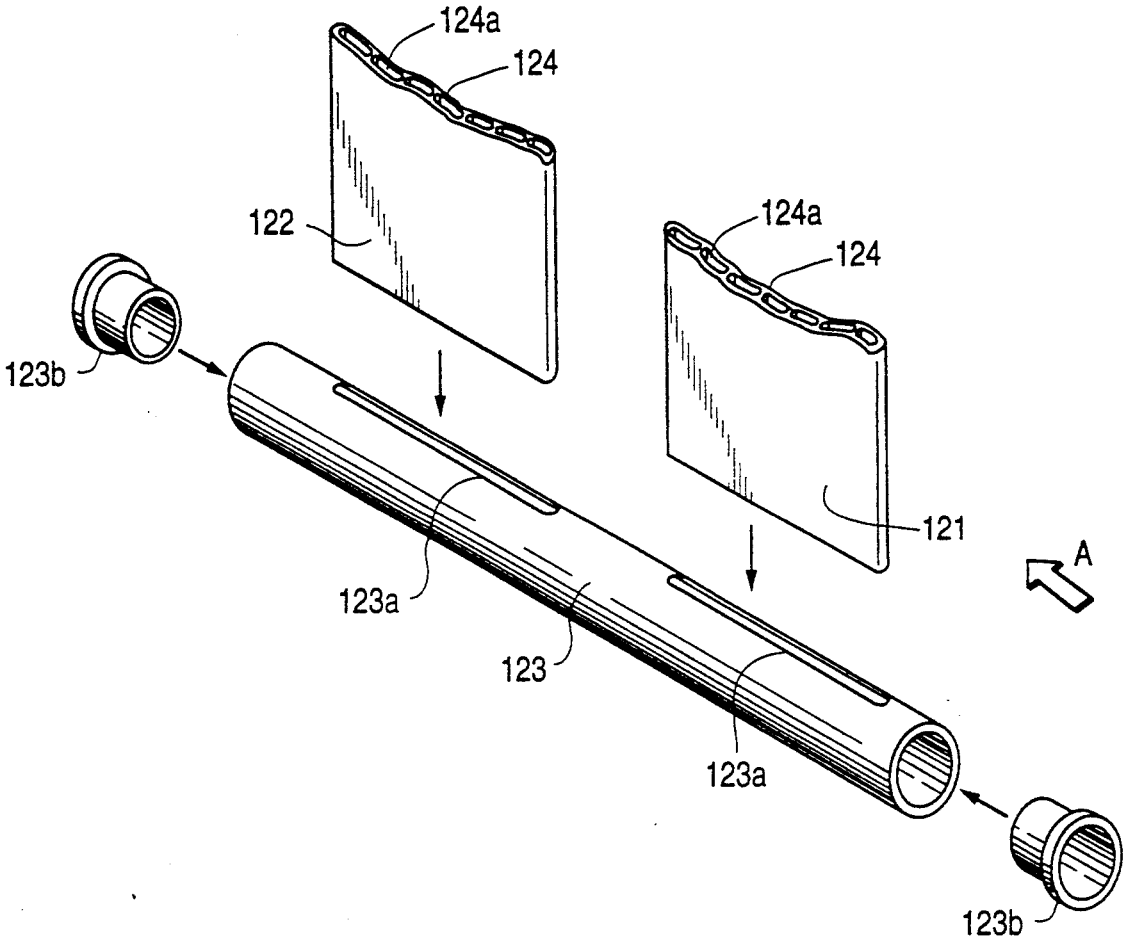
FIG. 7 illustrates an exploded perspective view of the communicating unit shown in FIG. 5.
Figure 6:
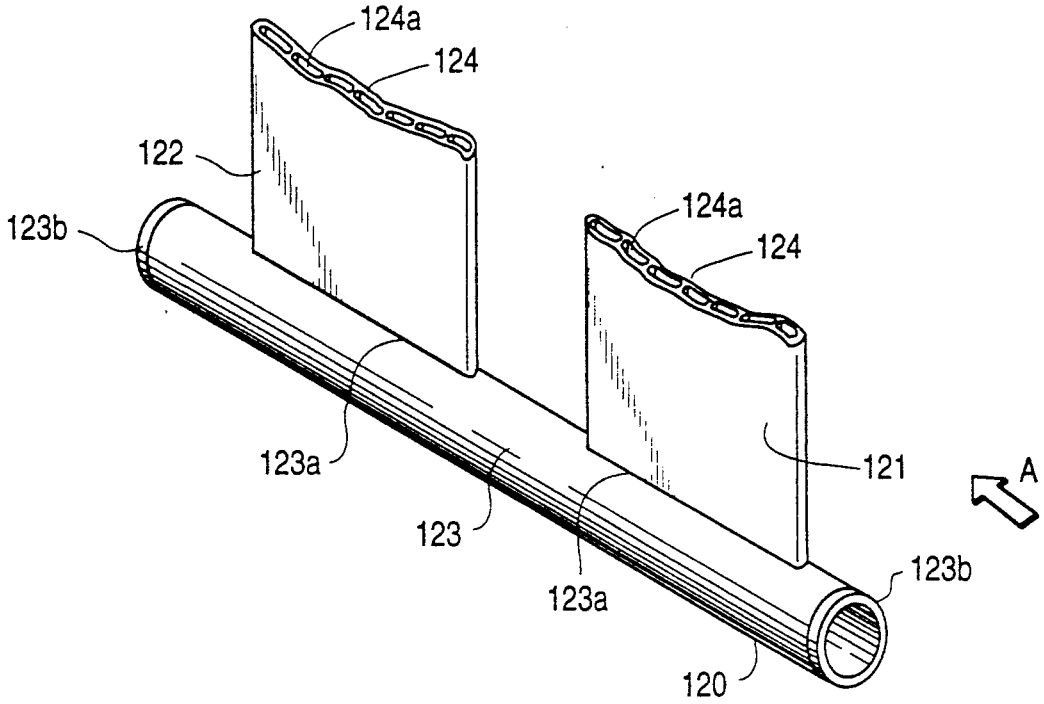
FIG. 6 illustrates a partial perspective view of a communicating unit shown in FIG. 5.

As shown in FIGS. 6 and 7, the interior space of each of flat tubes 121, 122 is divided by a plurality of parallel partition walls 124 into a corresponding plurality of essentially parallel passages 124*a* through which refrigeration fluid flows. A cap member 123*b* is fixedly and hermetically connected to each of the open ends of cylindrical tube 123.

An upper end of each of flat tubes 121 upwardly projects from an upper end of adjacent corrugated fin 12. The upper end of each flat tube 121 is fixedly and hermetically connected to a lower portion of first cylindrical header pipe 13 through slot 13*a* so as to enable communication between the interior space of cylindrical header pipe 13 with passages 124*a* defined within flat tube 121. An upper end of each of flat tubes 122 upwardly projects from an upper end of adjacent corrugated fin 12. The upper end of each flat tube 122 is fixedly and hermetically connected to a lower portion of second cylindrical header pipe 14 through slot 14*a* so as to enable communication between the interior space of cylindrical header pipe 14 with passages 124*a* defined within flat tube 122.

The function and effects of the second embodiment are similar to that of the first embodiment. Therefore, a description of the function and effects of the second embodiment is omitted.

This invention has been described in detail in connection with preferred embodiments. These embodiments, however, are merely for explanation only and the invention is not restricted thereto. It will be easily understood by those skilled in the art that other variations and modifications can easily be made within the scope of this invention, as described by the appended claims.

I claim:

1. An evaporator for use in a refrigeration circuit comprising:

first and second header pipes disposed substantially in parallel to each other; and a plurality of communicating members for providing communication between an interior space of the first header pipe and an interior space of the second header pipe, each of the plurality of communicating members including a first portion which communicates with the interior space of the first header pipe, a second portion which communicates with the interior space of the second header pipe, and a third portion which communicates between the first portion and the second portion, wherein the first, second and third portions of each communicating member extend along a plane which is parallel to a flow direction of a fluid which passes an exterior surface of the evaporator, and wherein the first portion, the second portion, and the third portion of at least one of the plurality of communicating members comprise a first flat pipe, a second flat pipe, and a cylindrical pipe connected to one end of each of the first and second flat pipes, respectively.

2. A heat exchanger comprising:

first and second header pipes disposed substantially in parallel to each other; and a plurality of communicating members for providing communication between an interior space of the first header pipe and an interior space of the second header pipe, each of the plurality of communicating members including a first portion which communicates with the interior space of the first header pipe, a second portion which communicates with the interior space of the second header pipe, and a third portion which communicates between the first portion and the second portion, wherein the first, second and third portions of each communicating member extend along a plane which is parallel to a flow direction of a fluid which passes an exterior surface of the heat exchanger, and wherein the first portion, the second portion, and the third portion of at least one of the plurality of communicating members comprise a first flat pipe, a second flat pipe, and a cylindrical pipe connected to one end of each of the first and second flat pipes, respectively.

* * * * *